US005080049A

United States Patent [19]

Solomon et al.

[11] Patent Number: 5,080,049

[45] Date of Patent: Jan. 14, 1992

[54] TWO STROKE ENGINE WITH TIERED CYLINDER COOLING

[75] Inventors: James G. Solomon, Grosse Pointe Woods; Robert A. Bolton, Rochester; Albert A. Miller, Warren; Cletus R. Abke, Jr., East Detroit, all of Mich.

[73] Assignee: General Motors Corporation, Detroit, Mich.

[21] Appl. No.: 698,036

[22] Filed: May 10, 1991

[51] Int. Cl.[5] ..... F01P 3/14

[52] U.S. Cl. ..... 123/41.78; 123/41.79

[58] Field of Search ..... 123/41.72, 41.74, 41.79, 123/41.78, 65 PE

[56] References Cited

U.S. PATENT DOCUMENTS

| | | | |
|---|---|---|---|
| 2,820,441 | 1/1958 | Scheiterlein | 123/41.46 |
| 2,989,953 | 6/1961 | Kessler et al. | 123/41.78 |
| 4,736,716 | 4/1988 | Ohyama | 123/41.78 |
| 4,969,329 | 11/1990 | Bolton et al. | 123/65 PE |
| 4,969,330 | 11/1990 | Groff et al. | 123/65 PE |
| 4,993,373 | 2/1991 | Klomp et al. | 123/65 PE |

FOREIGN PATENT DOCUMENTS

| | | | |
|---|---|---|---|
| 56-27021 | 3/1981 | Japan | 123/41.72 |

*Primary Examiner*—Noah P. Kamen

*Attorney, Agent, or Firm*—Robert J. Outland

[57] ABSTRACT

A two stroke cycle engine has tiered cooling jackets in the cylinder block with upper and lower jackets separated by a diaphragm wall. Transfer openings in the diaphragm and downward portions of the lower jacket direct coolant flow around exhaust ports and preferentially along the exhaust port side of the engine cylinder openings. A cylinder head gasket controls outflow from the upper jacket to the cylinder head through transfer holes placed preferably on the exhaust side of the upper jacket to provide overall control of flow in the cooling jacket system.

22 Claims, 2 Drawing Sheets

TWO STROKE ENGINE WITH TIERED CYLINDER COOLING

TECHNICAL FIELD

This invention relates to cooling jackets for two stroke cycle engines, commonly referred to as two stroke or two cycle engines. In particular, the invention relates to a tiered jacket for controlled cooling of the cylinders and exhaust port valves of a two stroke engine.

BACKGROUND

It is known in the art relating to two stroke engines of the type having cylinder exhaust ports to provide a cooling jacket to cool the upper portions of the engine cylinders above the ports where the cylinders are exposed to combustion gas temperatures. It is also known from U.S. Pat. No. 4,736,716 Ohyama to provide additional cooling for the engine piston through passages extending below the side exhaust and end transfer ports of an engine. These passages apparently do not extend below the side inlet ports opposite the exhaust ports but connect with a circumferential jacket portion above the ports.

SUMMARY OF THE INVENTION

The present invention provides a tiered cooling system including upper and lower jackets separated by a rigid diaphragm with openings spaced to control the coolant flow in and between the jackets. In engines with an exhaust valve for controlling the timing and/or separation of exhaust gas flow, the lower jacket preferably extends beside and below the exhaust ports to provide cooling to the exhaust valves for maintaining their dependable operation. Transfer holes may be located in the cylinder head gasket in a manner to control coolant outlet flow from and within the upper jacket to preferentially cool the hottest areas, such as above the exhaust ports.

These and other features and advantages of the invention will be more fully understood from the following description of certain specific embodiments of the invention taken together with the accompanying drawings.

BRIEF DRAWING DESCRIPTION

Figure 1:
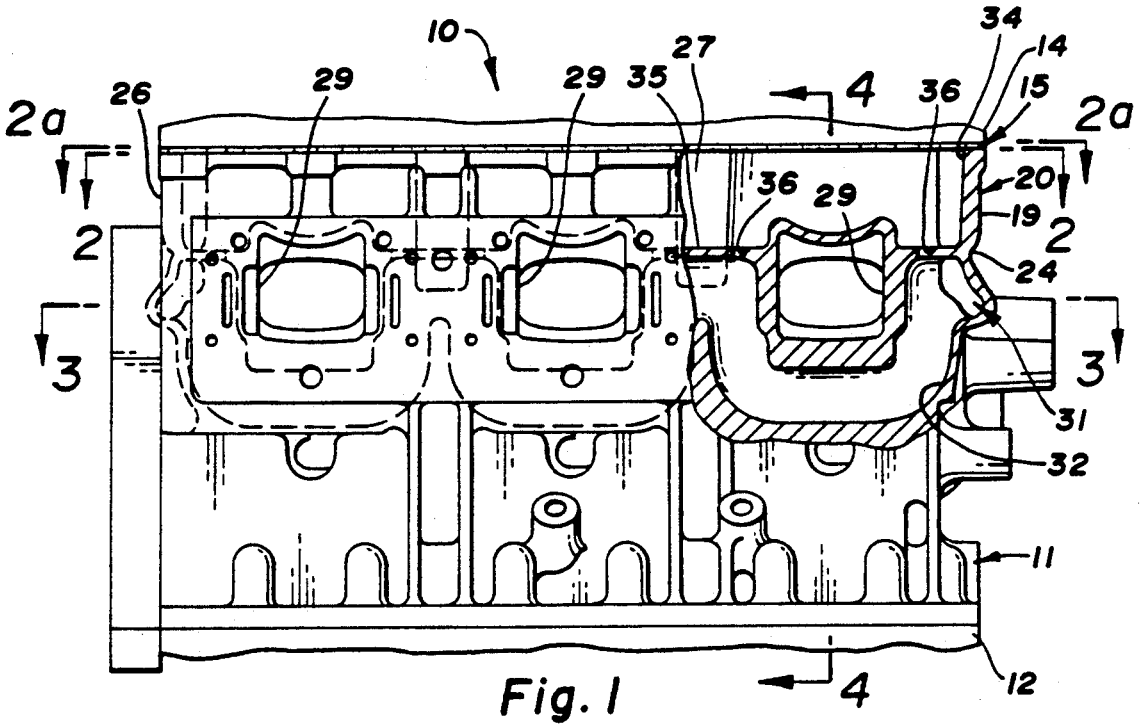
FIG. 1 is a side view showing pertinent portions of a two stroke engine including an integrally cast cylinder block and crankcase partially broken away to show cooling system means according to the invention.
Figure 2A:
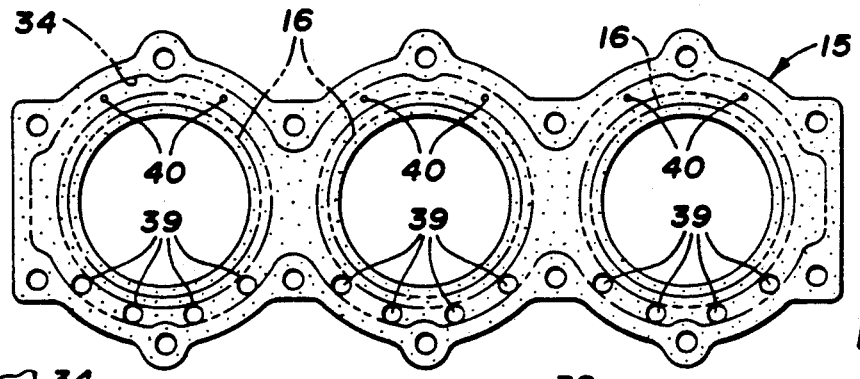
FIG. 2 is a plan view of the block portion of the engine from the plane of the line 2—2 of FIG. 1.
Figure 2:
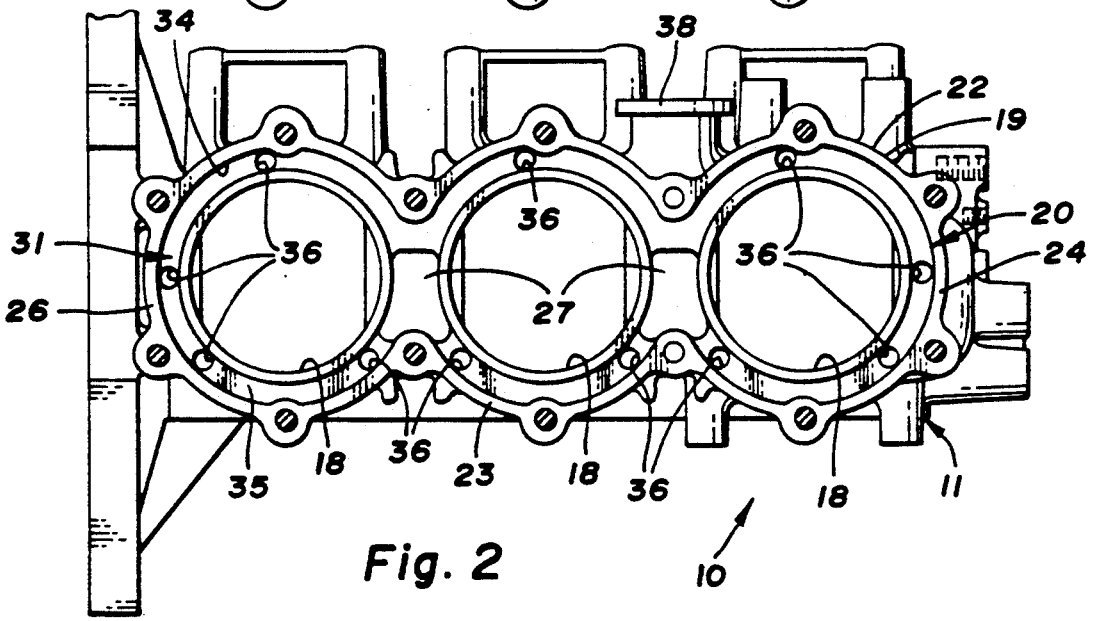
Figure 3:
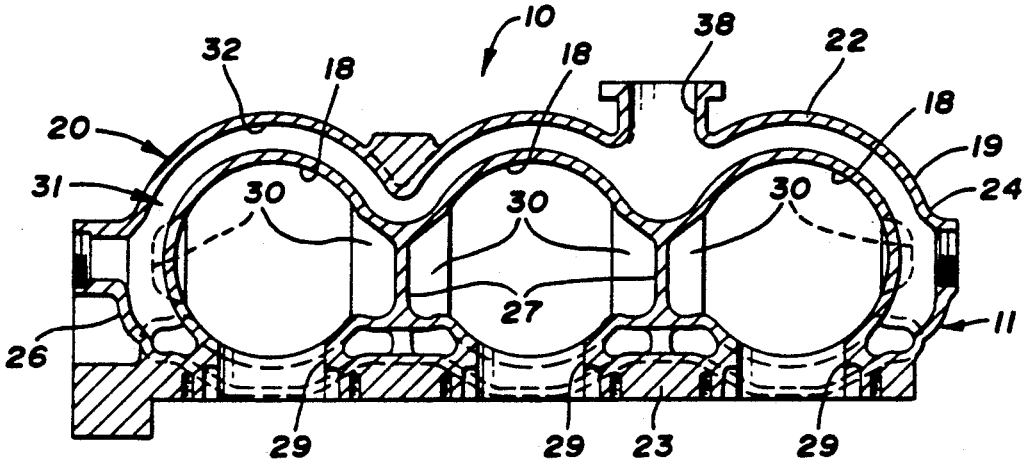
Figure 4:
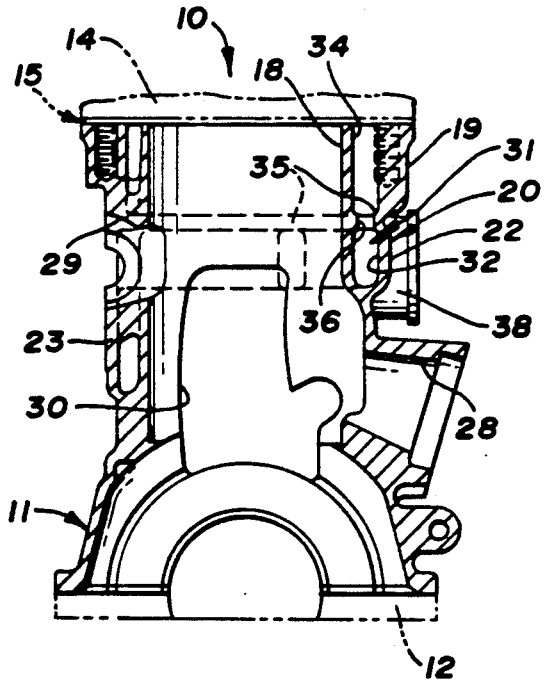
Figure 5:
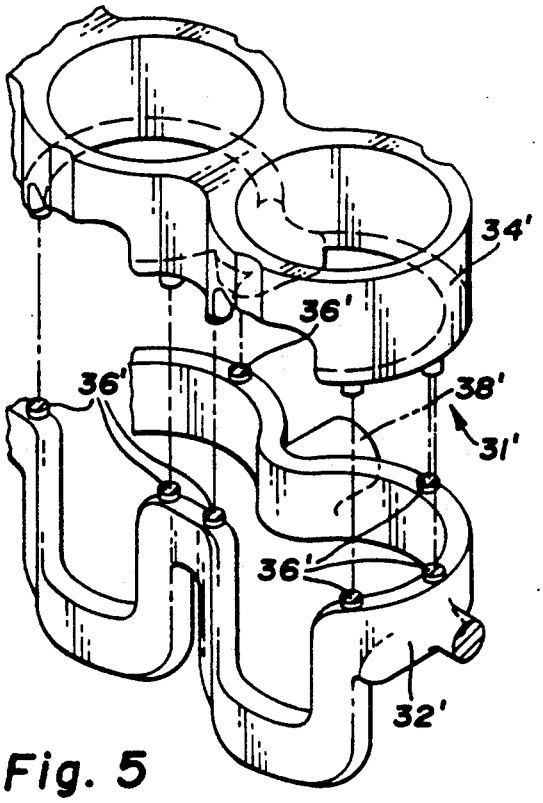

FIG. 2*a* is a plan view from the line 2*a*—2*a* of FIG. 1 showing the cylinder head gasket forming part of the engine cooling system;

FIG. 3 is a plan cross-sectional view from the plane of the line 3—3 of FIG. 1 showing the lower cooling jacket;

FIG. 4 is a transverse cross-sectional view from the plane of the line 4—4 of FIG. 1 showing one of the cylinder openings and the connecting ports; and FIG. 5 is a pictorial view of the joined casting cores and connecting openings forming the upper and lower jackets and illustrating the internal configuration of the jacket system.

DETAILED DESCRIPTION

Referring now to the drawings in detail, numeral 10 generally indicates a two stroke engine having a cylinder block 11 formed as an integral casting with portions of the usual crankcase and flywheel housing. The engine also includes a lower crankcase member 12 mounted on the bottom of the block 11 and a cylinder head 14 mounted on top of the block, the joint being sealed by a cylinder head gasket 15.

The engine may, for example, be of the type shown in U.S. Pat. No. 4,969,329 Bolton et al, assigned to the assignee of the present invention. Such engines include additional components such as crankshaft, pistons, intake and exhaust manifolds and valves and fuel supply means which are comparable to similar items of the present invention that are omitted from the drawings for clarity. Also included are cylinder liners 16 which are shown only in phantom in FIG. 2*a*.

The engine cylinder block and flywheel housing 11 includes a plurality of cylinder openings 18 aligned in a single cylinder bank 19 and adapted to receive the cylinder liners 16 (shown in FIG. 2*a*). Obviously, more or less than the three cylinder openings shown could be provided as could multiple cylinder banks, if desired. Side walls 20, including an inlet wall 22, exhaust wall 23 and end walls 24, 26 merge with transverse partition walls 27 to define the cylinder openings 18. Inlet ports 28 and exhaust ports 29 open to the cylinder openings 18 through the walls 22, 23 respectively. The partition walls 27 and the end walls 24, 26 have transfer ports 30 recessed therein. The recesses are closed in assembly by the cylinder liners 16. The inlet ports 28 are adapted to receive inlet check valves, such as reed valves, not shown, and the exhaust ports 29 are adapted to receive exhaust control valves, not shown, for example of the types shown in the previously mentioned U.S. Pat. No. 4,969,329.

The walls 22, 23, 24, 26, 27 internally define tiered cooling jacket means 31 which include a lower jacket 32 and an upper jacket 34 separated by a thin but rigid cross wall or diaphragm 35. Spaced transfer openings 36 in the diaphragm connect the upper and lower jackets for conducting coolant between them at the desired locations.

The lower jacket 32 extends around the cylinder openings 18 below the diaphragm 35 and above the inlet ports 28 and transfer ports 30. At the exhaust ports 29, the jacket 32 extends downwardly along both sides and along the bottom of each exhaust port to provide cooling to the ports and their associated valves, as well as the adjacent cylinder. An inlet connection 38 opens to the lower jacket 32 through the inlet wall 22, although it could be connected with any other desired part of the jacket 32. The upper jacket 34 extends around the cylinder openings above the exhaust ports 29 and the diaphragm 35.

The lower cooling jacket 32 is preferably of a smaller cross sectional flow area than the upper cooling jacket 34. This assures high flow velocities in the lower jacket, avoiding the possibility of dead flow regions that could cause hot spots. The transfer openings 36 are preferably positioned to direct coolant from the lower jacket 32 into the locations of the upper jacket 34 which will provide the most effective overall cooling. Optionally, openings 36 are located on either side of each of the exhaust ports 29 and at other spaced locations on the ends and inlet port side of the jacket. This provides turbulent jet cooling to the sides and upper portions of the exhaust ports and the desired flow distribution around other portions of the cylinder openings. The upper cooling jacket is formed with an open top which allows machining of the transfer openings at any desired locations of the diaphragm 35.

In FIG. 5, primed numerals indicate portions of the casting cores which form the corresponding jacket passages and openings. The transfer openings 36' are shown as cored although they may be drilled or otherwise machined in place as indicated above.

Coolant flow in the upper cooling jacket 34 may be further controlled by limiting the passage of coolant through the open top of the upper jacket into the associated cylinder head 14 to prepositioned transfer holes 39 provided in the cylinder head gasket 15. Preferably, the holes 39 are concentrated above the exhaust ports so that the hot cylinder bore on the exhaust port side is preferentially cooled. Additional holes 39 may be located at other points as desired and smaller steam vents 40 are provided at locations such as the intake port side, where extra cooling is not needed but where vapor pockets might develop without any through flow.

In operation, coolant is fed from the engine's water pump, not shown, to the lower jacket 32 so that this jacket contains the coolest liquid with which to cool the exhaust port area of the cylinders and the associated exhaust control valves. When the transfer openings 36 in the diaphragm 35 are strategically positioned with the transfer holes 39 in the head gasket 15, the entire coolant flow pattern around the cylinder bores is controlled as desired.

By directing flow in the lower jacket 32 around the sides and bottoms of the exhaust ports 29 and jet flow to the upper jacket via transfer openings 36 on either side of the ports 29, extra cooling of this high heat zone is provided. By further concentrating transfer holes 39 in the head gasket on the same side as the exhaust ports, additional cooling of the exhaust side of the upper cylinder bore is provided. However, the size and location of opening 36 and holes 39 in the diaphragm and head gasket, respectively, may be varied as desired in a particular embodiment to obtain the desired amount of coolant flow and cooling at every portion of the cooling system affected by the lower and upper coolant jackets.

While the invention has been described primarily by reference to a preferred embodiment, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A two stroke cycle engine comprising a cylinder block with a plurality of cylinder openings aligned in a single bank, the block having side walls internally defining cooling means adjacent at least upper parts of the cylinder openings, exhaust and inlet ports extending through the side walls to each of the cylinder openings, a rigid diaphragm transversely dividing the cooling means into tiered upper and lower cooling jackets, the lower jacket extending around the cylinder openings below the diaphragm and above the inlet ports, portions of the lower jacket extending adjacent both sides and underneath each exhaust port, the upper jacket extending around the cylinder openings above the exhaust ports, and openings in the diaphragm connecting the lower and upper jackets for conducting coolant between them.

2. An engine as in claim 1 wherein the lower jacket extends downwardly along both sides of each exhaust port.

3. An engine as in claim 1 wherein the totality of the diaphragm openings are sized to accelerate coolant flow between the jackets.

4. An engine as in claim 1 and further comprising means for admitting coolant from an external source to the lower jacket for first cooling the lower portions of the exhaust ports prior to passing into the upper jacket for cooling the tops of the exhaust ports and upper portions of the cylinder openings.

5. An engine as in claim 4 wherein the totality of the diaphragm openings are sized to accelerate coolant flow into and form turbulent coolant jets in the upper jacket.

6. An engine as in claim 5 wherein certain of the diaphragm openings are located adjacent either side of each of the exhaust ports to encourage rapid coolant flow around the exhaust ports in both the upper and lower jackets.

7. An engine as in claim 1 wherein certain of the diaphragm openings are located adjacent either side of each of the exhaust ports to encourage rapid coolant flow around the exhaust ports in both the upper and lower jackets.

8. An engine as in claim 7 and further comprising means closing the upper coolant jacket at upper ends of the cylinders, said closing means including outlet opening means for conducting coolant from the upper jacket to an adjacent cavity, a concentration of said outlet opening means being located on the exhaust port sides of the cylinder openings to provide increased cooling to the exhaust heated portions of the cylinder openings.

9. An engine as in claim 8 wherein the outlet opening means are a plurality of openings.

10. An engine as in claim 9 wherein the closing means is a cylinder head gasket.

11. A cylinder block having a plurality of cylinder openings aligned in a single bank and side walls internally defining cooling means adjacent at least upper parts of the cylinder openings, exhaust and inlet ports extending through the side walls to each of the cylinder openings, a rigid diaphragm transversely dividing the cooling means into tiered upper and lower cooling jackets, the lower jacket extending around the cylinder openings below the diaphragm and above the inlet ports, portions of the lower jacket extending adjacent both sides and underneath each exhaust port, the upper jacket extending around the cylinder openings above the diaphragm and the exhaust ports, and openings in the diaphragm connecting the lower and upper jackets for conducting coolant between them.

12. A cylinder block as in claim 11 wherein the lower jacket extends downwardly along both sides of each exhaust port.

13. A cylinder block as in claim 11 wherein the totality of the diaphragm openings are sized to accelerate coolant flow between the jackets.

14. A cylinder block as in claim 11 and further comprising means for admitting coolant from an external source to the lower jacket for first cooling the lower portions of the exhaust ports prior to passing into the upper jacket for cooling the tops of the exhaust ports and upper portions of the cylinder openings.

15. A cylinder block as in claim 14 wherein the totality of the diaphragm openings are sized to accelerate coolant flow into and form turbulent coolant jets in the upper jacket.

16. A cylinder block as in claim 15 wherein certain of the diaphragm openings are located adjacent either side of each of the exhaust ports to encourage rapid coolant flow around the exhaust ports in both the upper and lower jackets.

17. A cylinder block as in claim 11 wherein certain of the diaphragm openings are located adjacent either side of each of the exhaust ports to encourage rapid coolant flow around the exhaust ports in both the upper and lower jackets.

18. A cylinder block having a plurality of cylinder openings aligned in a single bank and walls internally defining cooling means adjacent at least upper parts of the cylinder openings, exhaust transfer and inlet ports in the walls at each of the cylinder openings, a rigid diaphragm transversely dividing the cooling means into tiered upper and lower cooling jackets, the lower jacket extending around the cylinder openings below the diaphragm and above the inlet and transfer ports, portions of the lower jacket extending adjacent both sides and underneath each exhaust port, the upper jacket extending around the cylinder openings above the diaphragm and the exhaust ports, and openings in the diaphragm connecting the lower and upper jackets for conducting coolant between them.

19. A cylinder block as in claim 18 wherein the lower jacket extends downwardly along both sides of each exhaust port.

20. A cylinder block as in claim 18 wherein the totality of the diaphragm openings are sized to accelerate coolant flow between the jackets.

21. A cylinder block as in claim 18 and further comprising means for admitting coolant from an external source to the lower jacket for first cooling the lower portions of the cylinder openings prior to passing into the upper jacket for cooling the tops of the exhaust ports and upper portions of the cylinder openings.

22. A cylinder block as in claim 21 wherein the totality of the diaphragm openings are sized to accelerate coolant flow into and form turbulent coolant jets in the upper jacket.

* * * * *